US006290293B1

(12) United States Patent
Long et al.

(10) Patent No.: US 6,290,293 B1
(45) Date of Patent: Sep. 18, 2001

(54) SEAT CUSHION ASSEMBLY

(75) Inventors: John F. Long; Darlene Long, both of South Haven; Joe A. Pena; Michelle Pena, both of Holland, all of MI (US)

(73) Assignee: Sit On Us, South Haven, MI (US)

( * ) Notice: Subject to any disclaimer, the term of this patent is extended or adjusted under 35 U.S.C. 154(b) by 0 days.

(21) Appl. No.: 09/458,181

(22) Filed: Dec. 7, 1999

(51) Int. Cl.[7] ..... A47C 31/00
(52) U.S. Cl. ..... 297/228.12; 297/DIG. 6
(58) Field of Search ..... 297/219.1, 228.12, 297/228.13, DIG. 6, 229, 219.12, 230.1, 220; 5/411, 922

(56) References Cited

U.S. PATENT DOCUMENTS 562,919 * 6/1896 Sager .
3,220,767 * 11/1965 Hendrickson .
3,934,933 * 1/1976 Long .
4,061,396 12/1977 Reida .
4,199,830 * 4/1980 Ogata .
4,199,831 * 4/1980 Muller .
4,512,047 4/1985 Johnson .
4,669,779 * 6/1987 Kaganas et al. .
4,828,320 5/1989 Saiger .
5,137,333 8/1992 Chee .
5,375,552 12/1994 Scott .
5,441,789 * 8/1995 Walker .
5,557,815 9/1996 Mintz et al. .
5,860,696 1/1999 Opavik et al. .
5,906,878 5/1999 Horning et al. .
6,089,659 * 7/2000 Toyota .

* cited by examiner

*Primary Examiner*—Milton Nelson, Jr.
(74) *Attorney, Agent, or Firm*—Factor & Partners, LLC

(57) ABSTRACT

A seat cushion assembly releasably securable to a chair comprising a cushion member having an upper surface for receiving an occupant and a lower surface opposite the upper surface for engaging the chair, at least three straps fastened to the cushion member, and a strap securing member fastenable to a bottom surface of the chair configured to releasably secure the at least three straps, and in turn, substantially preclude movement of the cushion upon the chair.

16 Claims, 3 Drawing Sheets

FIG 4B DASHED LINES ARE OPTIONAL

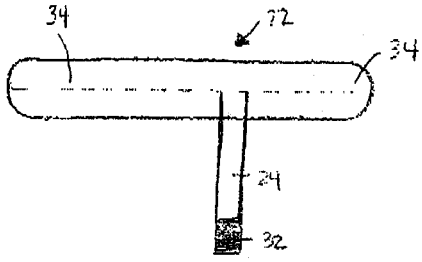
FIG 5
FIG 6A
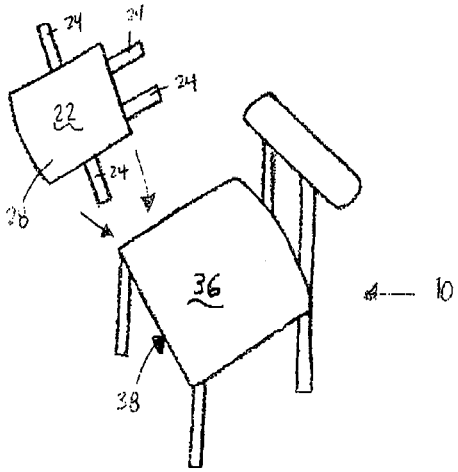
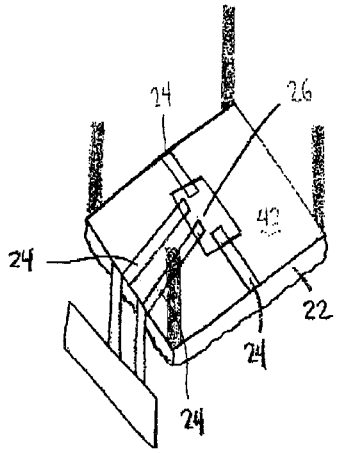
FIG 6B

SEAT CUSHION ASSEMBLY

BACKGROUND OF THE INVENTION

1. Field of the Invention

The present invention relates in general to seat cushions, and more particularly, to a seat cushion assembly having a plurality of fastening straps attached to a cushion member and a strap securing member which generally preclude undesirable movement and/or slippage of the cushion member when associated with a sitting surface, such as a chair or stool. The seat cushion assembly is also configured to substantially preclude inadvertent tearing of one or more of the fastening straps during normal use of the same.

2. Background Art

Seat cushions have been known in the art for years and have been the subject of numerous United States Patents, including: U.S. Pat. No. 5,137,333 entitled "Seat Cushion;" U.S. Pat. No. 5,557,815 entitled "Convertible Pillow/Chair Pad;" U.S. Pat. No. 4,512,047 entitled "Support Cushion;" U.S. Pat. No. 5,860,696 entitled "Cushion For A Chair, Especially A Detachable Cushion For A Child's Seat;" U.S. Pat. No. 5,375,552 entitled "Cushion For Removable Attachment To Platforms Of Boats Or The Like;" U.S. Pat. No. 4,828,320 entitled "Chair Frame And Cushion Assembly;" U.S. Pat. No. 5,906,878 entitled "Apparatus And Method For Deterring Slippage Of A Slip Cover Or Cushion Placed On Furniture;" and U.S. Pat. No. 4,061,396 entitled "Tie Down For Rotating Seat Cushions." Furthermore, numerous mechanisms for fastening a seat cushion to a chair are likewise well known. For example, some permanent fastening mechanisms include sewing, stapling, taping, and/or gluing the seat cushion directly to the sitting surface of the chair. While such fastening mechanisms have been readily used, their permanency can be problematic during, for example, remodeling. In addition, permanently secured seat cushions can not be readily cleaned in a conventional washing machine; instead they must be cleaned with an extractor while being secured to the chair. As such, permanently fastened seat cushions are not always desirous.

Seat cushions comprising non-permanent or detachable fastening mechanisms are also known and primarily include two pair of straps or tie downs, which are generally knotted to back support dowels of a chair to secure the seat cushion in place. While tie down or strapping mechanisms associated with support dowels provide a user with the ability to remove the cushion for cleaning and/or remodeling, they are only secured on one side, thereby leaving them generally free to shuffle, shift, pivot, twist and/or otherwise move. Such movement can not only be problematic or an annoyance to a user, but, over time, can hasten tearing of the support straps.

It is therefore an object of the present invention, to provide a seat cushion that, among other things, remedies the aforementioned detriments and/or complications associated with the use of conventional seat cushions.

SUMMARY OF THE INVENTION

The present invention is directed to a seat cushion assembly releasably securable to a chair comprising: (a) a cushion member having an upper surface for receiving an occupant and a lower surface opposite the upper surface for engaging the chair; (b) at least three straps fastened to the cushion member; and (c) a strap securing member fastenable to a bottom surface of the chair configured to releasably secure the at least three straps, and in turn, substantially preclude movement of the cushion upon the chair.

In a preferred embodiment of the invention, the at least three straps are securable to the strap securing member substantially in the absence of angular strain, to in turn, substantially minimize tearing of one or more of the at least three straps from the cushion member. In this embodiment the seat cushion preferably comprises four straps.

In another preferred embodiment of the invention, two of the at least three straps are fastened to the cushion member at opposite sides so that, upon fastening to the strap securing member, the two straps form a substantially linear strip along the bottom surface of the chair.

In yet another preferred embodiment of the invention, the at least three straps are secured to the strap securing member by a loop and hook fastener and the strap securing member is fastenable to the bottom surface of the chair by adhesive tape. In this embodiment the strap securing member may be substantially rectangular and/or comprise regions that are substantially linear to the at least three straps.

The present invention is further directed to a seat cushion assembly releasably securable to a chair comprising: (a) a cushion member having an upper surface for receiving an occupant and a lower surface opposite the upper surface for engaging the chair; (b) four straps fastenable to the cushion member, wherein two of the four straps are fastened at opposite sides of the cushion member; and (c) a strap securing member fastenable to a bottom surface of the chair configured to releasably secure the four straps, and in turn, substantially preclude movement of the base upon the chair.

The present invention is also directed to a chair having a releasably secured seat cushion assembly comprising: (a) at least one leg; (b) a substantially horizontal occupant support member having a sitting surface and a bottom surface opposite the sitting surface; and (c) a seat cushion assembly comprising: (1) a cushion member having an upper surface for receiving an occupant and a lower surface opposite the upper surface positioned upon the sitting surface of the chair; (2) a strap securing member fastened to the bottom surface of the chair; and (3) at least three straps fastened the cushion member at a first end and releasably secured to the strap securing member at a second end to, in turn, substantially preclude movement of the seat cushion upon the chair.

BRIEF DESCRIPTION OF THE DRAWINGS

The invention will now be described with reference to the drawings wherein:

FIG. 4B of the drawings is a top plan view of various alternative embodiments of strap configurations in accordance with the present invention;

FIG. 5 of the drawings is a side elevation view of a present invention cushion member having a strap secured thereto along a seem line;

FIG. 6A of the drawings a perspective view of a chair and an unassociated seat cushion assembly of the present invention; and FIG. 6B of the drawings is an inverted perspective view of a chair showing a plurality of straps secured to a strap securing member in accordance with the present invention.

DETAILED DESCRIPTION OF THE DRAWINGS

Figure 1:
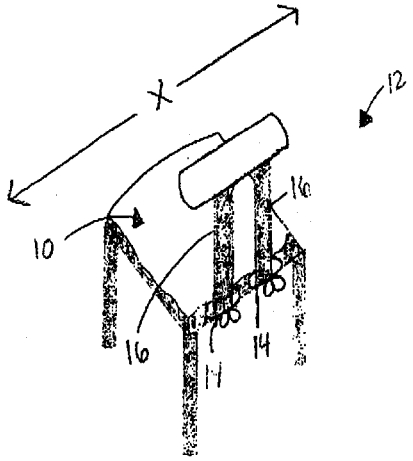
FIG. 1 PRIOR ART
FIG. 1 of the drawings is perspective view of a prior art seat cushion associated with a chair showing the tie down fastening mechanism.

While this invention is susceptible of embodiment in many different forms, there is shown in the drawings and will herein be described in detail several embodiments with the understanding that the present disclosure is to be considered as an exemplification of the principles of the invention and is not intended to limit the invention to the embodiments illustrated.

Figure 2:
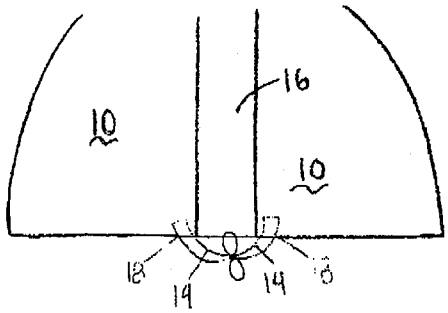
FIG. 2 PRIOR ART
FIG. 2 of the drawings is a fragmented rear view of a prior art seat cushion showing stress points associated with the tie downs.

Referring now to the drawings and to FIG. 1 in particular, prior art seat cushion 10 is shown as attached to chair 12, by two pairs of tie downs straps 14. As can be seen in FIG. 2, tie down straps 14 are knotted to back support dowel 16 of chair 12, and a substantial degree of angular strain is imparted upon each of the tie down straps 14 at points 18. Such angular strain can facilitate premature tearing of tie down straps 14—rending seat cushion 10 unsecurable without repair.

In addition, as can be seen in FIG. 1, because tie down straps 14 are merely knotted to back support dowels 16, seat cushion 10 is fastened at only one end. As such, seat cushion 10 is generally free to slide laterally along axis X, which can place additional angular strain upon tie down straps 14. The angular strain can lead to, among other things, loosening and/or breaking of tie down straps 14, which in turn, undesirably allows seat cushion 10 to shift, pivot, swivel, slide, and otherwise move upon chair 12.

Figure 3:
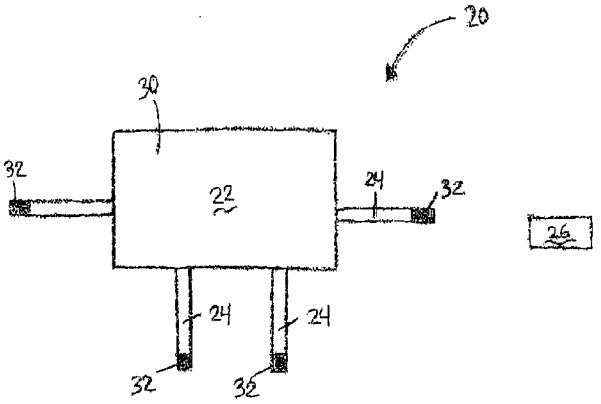
FIG. 3. of the drawings is a bottom plan view of a seat cushion assembly in accordance with the present invention.

Referring now to the present invention and to FIG. 3 in particular, seat cushion assembly 20 is shown, prior to association with a chair, as comprising cushion member 22, a plurality of straps 24, and strap securing member 26.

Figure 4A:
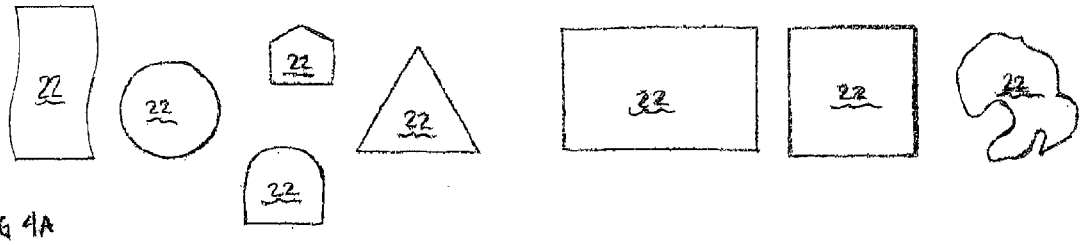
FIG. 4A of the drawings is a top plan view of various alternative embodiments of cushion members in accordance with the present invention.

Cushion member 22 includes upper surface 28 (See FIG. 6A) for receiving an occupant and lower surface 30 (See FIG. 3) opposite upper surface 28 for engaging a chair. While cushion member 22 is shown in FIG. 3, for illustrative purposes only, as comprising a shape that conforms to the peripheral geometry of a conventional chair, any one of a number of geometric configurations are likewise contemplated for use including, substantially rectangular, substantially square, substantially circular, and/or substantially arbitrary as shown in FIG. 4A. Cushion member 22 is preferably fabricated from a material outer liner filled with, for example, polyurethane foam. However, numerous other liners and fillers known to those having ordinary skill in the art are likewise contemplated for use. In addition, cushion member 22 may also be void of a filler so as to serve as a slip cover for an existing cushion member or pad. Although not shown, it will be understood that cushion member 22 may comprise a zipper so that a filler material may be removed during washing of the cushion member. For purposes of the present disclosure cushion member 22 may also be fabricated from a solid piece of formed material including numerous conventional natural and synthetic resins.

Straps 24 are preferably generally planar, generally rectangular pieces of material (typically the same material that comprises the outer liner of cushion member 22) and include means 32 for securing straps 24 to strap securing member 26. A preferred means for securing straps 24 to strap securing member 26 comprises a conventional hook and loop fastener, which is commercially available from numerous sources and sold under the mark VELCRO.® It will be understood however, that numerous other means for securing straps 24 can likewise be used including, for example, snapping mechanisms and adhesive type means. It will be understood that the means for fastening may be, for example, sewn onto each one of straps 24, or, alternatively, may be attached via conventional glue or adhesive tape.

As is shown in FIG. 5, straps 24 can be fastened to cushion member 22 along seem 34. Straps 24 are preferably sewn directly into the cushion member, but other attaching mechanisms, either as alternative or supplemental mechanisms can likewise be used, such as gluing and/or stapling. In addition, straps 24 can be ironed onto a portion of cushion member 22, which can be especially helpful for repairing, and in turn, converting, a prior art seat cushion of FIG. 1 into a seat cushion assembly in accordance with the present invention.

As will be explained in greater detail below, while four straps 24 have been disclosed as being fastened to cushion member 22, it has been experimentally determined that a three strap configuration is also suitable for purposes of the present invention. It will be understood that while the minimal strapping configuration has been disclosed as three, the upper limit of straps is essentially limitless and depends primary upon the size and peripheral geometry of the chair. Examples of other strapping configurations in accordance with the present invention are shown in FIG. 4B.

Figure 4C:
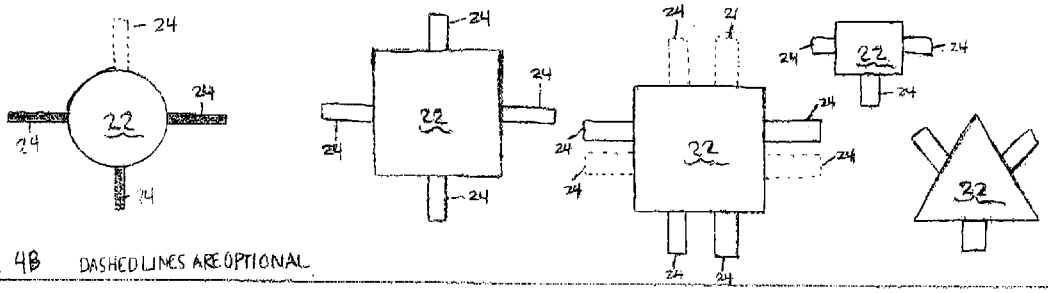
FIG. 4C of the drawings is a top plan view of various alternative embodiments of strap securing member configurations in accordance with the present invention.
Figure 4C:
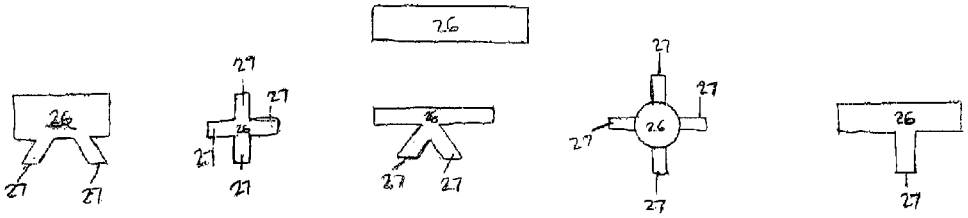

Referring again to FIG. 3, strap securing member 26 comprises a generally rectangular piece VELCRO® which is attachable to the bottom of a chair preferably via pressure sensitive adhesive tape or glue. While strap securing member 26 has been disclosed as comprising a rectangular piece of VELCRO,® other geometric configurations are likewise contemplated for use including, for example, those of FIG. 4C. As is shown in FIG. 4C, strap securing member 26 may comprise regions 27 that run linear to one or more of straps 24 for increased securability.

As can be seen in FIG. 6A, upon articulation, a person positions lower surface 30 of cushion member 22 upon sitting surface 36 of substantially horizontal occupant support member 38 of chair 40. Once cushion member 22 is positioned on chair 40, a strap securing member can be operatively positioned and subsequently fastened to bottom surface 42 of occupant support member 38. Operative positioning is carried out by aligning seat cushion member 22 in accordance with the peripheral geometry of substantially horizontal occupant support member 38 and then taughtly strapping each of straps 24 around the side of chair 40 to bottom surface 42. After the position of the straps 24 is determined, then strap securing member 26 can be applied to the bottom surface 42 of horizontal support member 38. Next, each of straps 24 are secured thereto, thereby securely fastening cushion member 22 to chair 40. It will be understood that inasmuch as cushion member 22 is secured to chair 40 by a non-permanent loop and hook fastening mechanism, cushion member 22 can be easily removed for cleaning and/or remodeling.

As is further shown in FIG. 6B, straps 24 are secured to strap securing member 26 in the absence angular strain, which serves to substantially preclude tearing of one or more of straps 24 from cushion member 22. In addition, inasmuch as straps 24 are associated with three sides of cushion member 22, movement or slippage is greatly reduced.

As can be further seen in FIG. 6B two of straps 24 are fastened to cushion member 22 at opposite ends so that the two straps form a substantially linear strip, which further serves to reduce undesired movement.

While seat cushion assembly 20 has been disclosed as being associated with a conventional chair 40 having four legs and a back support, it will be understood that seat cushion assembly 20 can likewise be used with, for example, a stool having a single pedestal or leg with or without a back support. Indeed, the seat cushion assembly of the present invention can be utilized in virtually every sitting application—so long as the particular "chair" or sitting surface includes a bottom surface for proper fastening as disclosed herein.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. A seat cushion assembly releasably securable to a chair, comprising:

a cushion member having an upper surface for receiving an occupant and a lower surface opposite the upper surface for engaging the chair;

at least three straps fastened to the cushion member; and a strap securing member fastenable to a bottom surface of the chair configured to releasably secure the at least three straps, and in turn, substantially preclude movement of the cushion upon the chair, wherein the at least three straps are secured to the strap securing member by a loop and hook fastener.

2. The seat cushion assembly according to claim 1, wherein the at least three straps are securable to the strap securing member substantially in the absence of angular strain, to in turn, substantially minimize tearing of one or more of the at least three straps from the cushion member.

3. The seat cushion assembly according to claim 1, wherein two of the at least three straps are fastenable to the cushion member at opposite sides so that, upon fastening to the strap securing member, the two straps are adapted to form a substantially linear strip along the bottom surface of the chair.

4. The seat cushion assembly according to claim 1, wherein the strap securing member comprises regions that are substantially linear to the at least three straps.

5. The seat cushion assembly according to claim 1, comprising four straps fastened to the cushion member.

6. The seat cushion assembly according to claim 1, wherein the strap securing member is fastenable to the bottom surface of the chair by adhesive tape.

7. The seat cushion assembly according to claim 1, wherein the strap securing member is substantially rectangular.

8. A seat cushion releasably securable to a chair, comprising:

a cushion member having an upper surface for receiving an occupant and a lower surface opposite the upper surface for engaging the chair;

four straps fastenable to the cushion member, wherein two of the four straps are fastened at opposite sides of the cushion member; and a strap securing member fastenable to a bottom surface of the chair configured to releasably secure the four straps, and in turn, substantially preclude movement of the cushion member upon the chair, wherein the four straps are secured to the strap securing member by a loop and hook fastener.

9. A chair having a releasably secured seat cushion, comprising:

at least one leg;

a substantially horizontal occupant support member having a sitting surface and a bottom surface opposite the sitting surface; and a seat cushion comprising:

a cushion member having an upper surface for receiving an occupant and a lower surface opposite the upper surface positioned upon the sitting surface of the chair;

a strap securing member fastened directly to the bottom surface of the chair by adhesive tape; and at least three straps fastened to the cushion member at a first end and releasably secured to the strap securing member at a second end to, in turn, substantially preclude movement of the seat cushion upon the chair.

10. The chair according to claim 9, further comprising a back support.

11. The chair according to claim 9, wherein the at least three straps are secured to the strap securing member substantially in the absence of angular strain, to in turn, substantially minimize tearing of the at least three straps from the cushion member.

12. The chair according to claim 9, wherein two of the at least three straps are fastened to the cushion member at opposite sides so that the two straps form a substantially linear strip along the bottom surface of the chair.

13. The chair according to claim 9, wherein the at least three straps are secured to the strap securing member by a loop and hook fastener.

14. The chair according to claim 9, comprising four straps fastened to the cushion member.

15. The chair according to claim 9, wherein the strap securing member comprises regions that are substantially linear to the at least three straps.

16. The chair according to claim 9, wherein the strap securing member is substantially rectangular.

* * * * *